United States Patent [19]

Bossi et al.

[11] 4,088,096

[45] May 9, 1978

[54] INTERNAL COMBUSTION ENGINE COMPRISING AN EXHAUST SYSTEM PROVIDED WITH PROBES FOR EXHAUST GAS ANALYSIS

[75] Inventors: Gianfranco Bossi; Edoardo Rogora, both of Milan, Italy

[73] Assignee: Alfa Romeo S.p.A., Milan, Italy

[21] Appl. No.: 768,780

[22] Filed: Feb. 15, 1977

[30] Foreign Application Priority Data

Feb. 16, 1976 Italy ..... 20197 A/76

[51] Int. Cl.[2] ..... F02B 75/10; F02D 35/00

[52] U.S. Cl. ..... 123/32 EE; 60/276; 123/119 EC

[58] Field of Search ..... 123/32 EE, 119 EC, 119 E; 60/276

[56] References Cited

U.S. PATENT DOCUMENTS

| | | | |
|---|---|---|---|
| 3,744,461 | 7/1973 | Davis | 123/32 EE |
| 3,768,259 | 10/1973 | Carnahan et al. | 123/32 EE |
| 3,910,240 | 10/1975 | Omori et al. | 123/32 EE |
| 3,923,016 | 12/1975 | Hoshi | 123/32 EE |
| 3,926,154 | 12/1975 | Williams | 123/32 EE |
| 3,945,204 | 3/1976 | Knapp | 60/276 |
| 3,949,551 | 4/1976 | Eichler et al. | 123/32 EE |
| 4,000,614 | 1/1977 | Abthoff et al. | 60/276 |
| 4,030,292 | 6/1977 | Masaki et al. | 60/276 |
| 4,052,968 | 10/1977 | Hattori et al. | 123/119 EC |

FOREIGN PATENT DOCUMENTS

| | | | |
|---|---|---|---|
| 2,255,874 | 11/1972 | Germany | 123/32 EE |

*Primary Examiner*—Wendell E. Burns

*Attorney, Agent, or Firm*—Diller, Brown, Ramik & Wight

[57] ABSTRACT

This invention relates to an internal combustion engine having an exhaust system provided with probes for exhaust gas analysis. The exhaust system comprises plurality of exhaust ducts attached to and communicating with respective engine cylinders, individual ducts into which said exhaust ducts discharge at least in pairs and one exhaust pipe into which said exhaust ducts discharge. There are provided at least two probes, at least one of which is disposed in one of said ducts upstream of said exhaust pipe, whereas another probe is disposed either in said exhaust pipe or in one of said ducts. Said probes are connected to suitable devices for controlling the physical quantities relating to the operation of the engine.

7 Claims, 2 Drawing Figures

INTERNAL COMBUSTION ENGINE COMPRISING AN EXHAUST SYSTEM PROVIDED WITH PROBES FOR EXHAUST GAS ANALYSIS

In the field of anti-pollution devices for internal combustion engines, probes have recently been conceived for determining the presence of a certain component (oxygen, carbon monoxide) in the engine exhaust gas and capable of emitting an electrical signal as a function of the concentration of the component under examination in the gas.

In particular, zirconium oxide-based probes are used for determining the quantity of oxygen or carbon monoxide in the engine exhaust gas.

In practice, these probes are concentration cells containing a solid electrolyte consisting of a layer of suitably stabilised zirconium oxide coating the two faces of two layers of platinum which constitute the porous electrodes. The two electrodes are in contact with air and with the exhaust gas, so that above a determined threshold temperature the different oxygen concentration establishes an electrical potential between the two electrodes which is a function of the oxygen concentration in the gas and thus of the air-petrol ratio of the engine feed mixture. Generally two alternative voltage levels are established at the probe terminals connected to the electrodes, one corresponding to a weak mixture and the other corresponding to a rich mixture.

The composition of the exhaust gas obviously varies according to the strength of the mixture drawn in. Thus the electrical signal emitted by the probe, which indicates the conditions under which the engine is used, may be utilised as a control parameter. If the motor is provided with a petrol feed control device, the signal provided by the probe may be used as a feed-back signal to correct the strength of the air-petrol mixture drawn in by the engine. Alternatively, if the engine is provided with a device for blowing post-combustion air into the exhaust gas, the signal provided by the probe may be used for controlling the flow rate of the injected air, so as to ensure that the post-combustion process operates correctly.

For simplicity, the exhaust gas analysis probe is usually arranged in the engine exhaust system in the one duct into which generally all the individual exhaust ducts from the various cylinders flow, so that the probe is associated with the total flow of exhaust gas from the engine and is able to determine the average concentration of the examined component in the exhaust gas from all cylinders.

Where the exhaust system ducts are of considerable length upstream of the region in which they coverge, the point at which the probe is arranged is rather far from the engine head, and during the engine heating period the gas may not reach the probe sufficiently hot to activate it. As the internal resistance of the probe is very high below the threshold temperature (it decreases with rising temperature) and the electrical potential across the probe terminals is insignificant whatever the exhaust gas composition, the probe is not able to provide any useful information regarding the strength of the engine feed mixture until the activation temperature is reached. Thus during this time period there is no signal for controlling the control devices.

In general the engine exhaust gas temperature decreases in passing from the region close to the head to the region of exit to atmosphere because of heat exchange with these surroundings, and this heat dispersion is obviously more intense the greater the length of the exhaust ducts, as in the case of engines provided with an exhaust system consisting of an initial plurality of ducts of a number equal to the number of engine cylinders, flanged to the engine head, with the said exhaust ducts flowing at least in pairs into individual ducts which in their turn flow into a main exhaust pipe.

With an exhaust system of this type, the operating difficulties of the exhaust gas analysis probe deriving from its usual unfavourable positioning may be obviated according to a first embodiment of the present invention by disposing a first probe in the main exhaust pipe into which the exhaust ducts from all the engine cylinders flow, and at least one second probe in at least one of the exhaust ducts situated upstream of said main exhaust pipe.

The second probe may be arranged in one of the individual exhaust ducts into which the exhaust ducts flanged to the engine head flow at least in pairs, or it may be arranged in one of the actual exhaust ducts flanged to the engine head.

With this method at least one probe is very close to the engine head, i.e. in a region in which the gas is certainly hotter than it is in the region in which all the exhaust ducts from the various cylinders converge, even during the heating up of the engine. This probe is therefore able to operate before the probe disposed farther from the head. Thus even where the engine is used under these conditions, a control signal is available.

When the probe disposed in the region in which all the exhaust ducts converge reaches the running temperature after activation, the probe closer to the engine head may be disconnected by switching means operated by means sensitive to a parameter which indicates the conditions of operation of the probe farther from the head, and the signal supplied by this probe may then be used as the control parameter alone.

The probe closer to the head obviously analyses only part of the engine exhaust gas, namely that from only the cylinder or cylinders connected directly to the individual duct in which the probe is located, and the signal supplied by the probe relative to the average concentration of the examined component in the exhaust gas is more accurate in indicating the working conditions of the engine the more uniform the behaviour of the various engine cylinders.

In practice it may happen that the various cylinders do not operate uniformly because the mixture is not distributed uniformly into the cylinders and the combustion of the load is complete to a greater or lesser extent in one cylinder than in another. The composition of the exhaust gas from each cylinder may therefore be different.

While the probe closer to the engine head is associated only with part of the exhaust gas flow, the probe disposed where all the engine exhaust ducts flow together is associated with the total engine exhaust gas flow, and gives an indication of the average concentration of the examined component in the exhaust gas from all cylinders,. This signal is without doubt more credible and significant in indicating the engine operating conditions than that provided by the probe which analyses only a partial flow of the engine exhaust gas, but because of its location no signal can be emitted by the probe farther from the head until the gas has reached a sufficient temperature to activate it in the confluence region.

In a further embodiment of the present invention, a probe may be arranged in at least two of the individual ducts into which the exhaust ducts flanged to the engine head flow at least in pairs, whereas no probe is arranged in the region in which all the engine exhaust ducts flow together.

The probes are thus all located in a region very close to the engine head in which the gas is sufficiently hot to activate them into a state of conduction even during the heating up of the engine, and consequently they are able to operate normally over the entire range through which the engine is used.

With this arrangement, each probe analyses only part of the engine exhaust gas, namely that from the cylinders connected directly to the individual duct in which the probe is arranged. Consequently each duct provides an electrical signal which is a function of the average concentration of the examined component in that part of the total exhaust gas flow traversing the relative duct. The signals provided by the probes are equal only if the engine cylinders are aligned, otherwise they are different. Thus signals are available which enable the performance of the various cylinder groups or the relative exhaust ducts to be compared.

In this case, to control the control devices the signals provided by the probes may be processed in suitable processing means before arriving at the control devices in order to obtain a single control signal. For example, of all the signals, that signal may be used which exceeds a predetermined limit or which falls within a predetermined range. The lowest of the signals may possibly be used to define the maximum amplitude of the range of operation of the signal which is taken as the control parameter.

Characteristics and advantages of the present invention will be more evident from an examination of FIGS. 1 and 2 which show an embodiment of the invention in accordance with the first proposed method.

Figure 1:
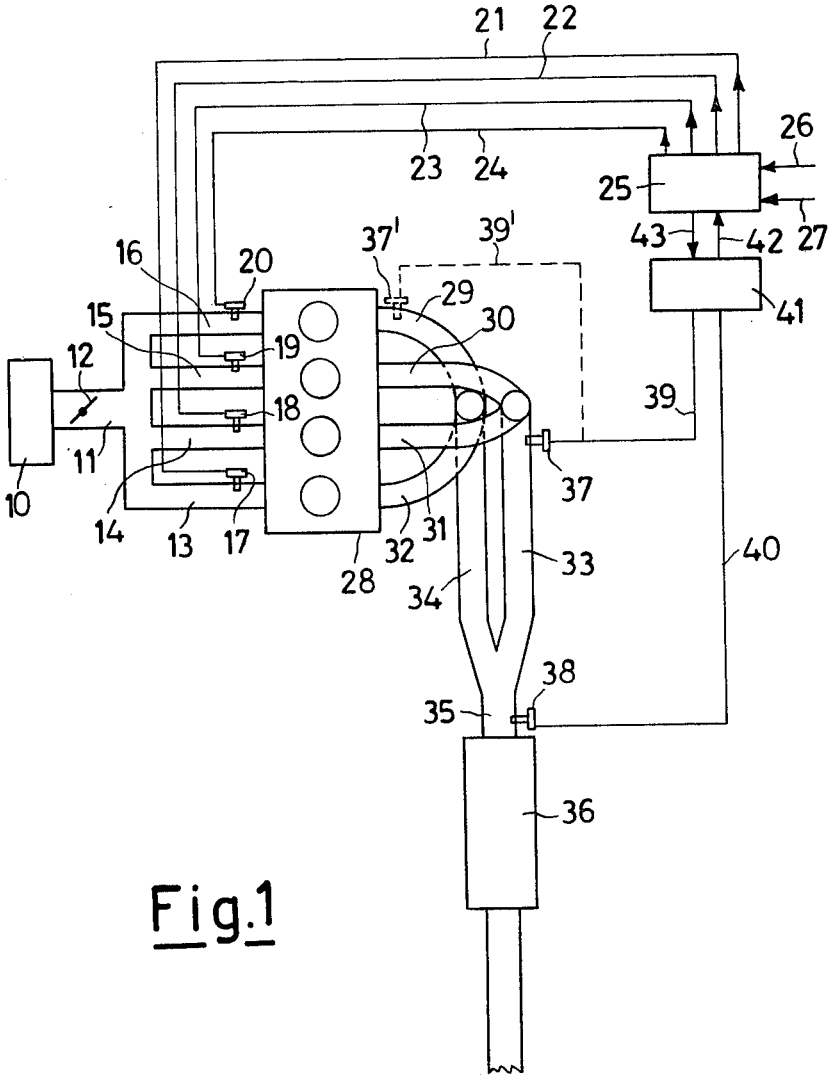
FIG. 1 shows a four cylinder internal combustion engine provided with an electronic petrol injection system and comprising a control device governed by two exhaust gas analysis probes in accordance with the present invention.

FIG. 1 shows the engine air intake filter 10 and the intake manifold 11 provided with the choke for the air drawn in. The reference numerals 13, 14, 15 and 16 indicate the individual feed ducts to the engine cylinders and the reference numerals 17, 18, 19 and 20 indicate the electro-injectors arranged in said individual feed ducts. The electro-injectors are connected via respective conductors 21, 22, 23, 24 to an injection control device diagrammatically indicated by the block 25. The block 25 receives the signals which are functions of the engine operation parameters (speed of rotation, choke angle etc.) and on which the control of petrol injection depends. For simplicity two of these signals, 26 and 27, are indicated. The engine block, also shown diagrammatically is indicated by 28 and the reference numerals 29, 30, 31, 32 indicate the exhaust ducts connected directly to the engine cylinders and flanged to its head. The exhaust ducts 29 and 32 flow into the individual exhaust duct 33 and the ducts 30 and 31 flow into the individual exhaust duct 34. The individual exhaust ducts 33 and 34 flow in their turn into the main exhaust pipe 35. Exhaust gas post-combustion chambers and silencers may be connected into the main exhaust pipe 35. One such chamber, 36, is shown in the figure.

One exhaust gas analysis probe 37 is disposed in the individual exhaust duct 33. A second probe 38 is disposed in the main exhaust pipe 35.

The two probes are of a type able to determine the presence or absence of oxygen in the engine exhaust gas, for example probes based on zirconium oxide. The probe 37 is able to emit a signal representing the average oxygen concentration in the gas from the two cylinders of the engine 28 connected to the duct 33 via the exhaust ducts 29 and 32. The probe 38 is able to emit a signal representing the average oxygen concentration in the total exhaust flow from the engine.

As stated, the signals emitted by the probes for determining oxygen in the exhaust gas consist of two voltage levels which decrease substantially asymptotically with increasing temperature, from the activation temperature to the normal running temperature. These two voltage levels represent the oxygen concentration in the exhaust gas corresponding respectively to a rich feed mixture and a weak mixture.

Figure 2:
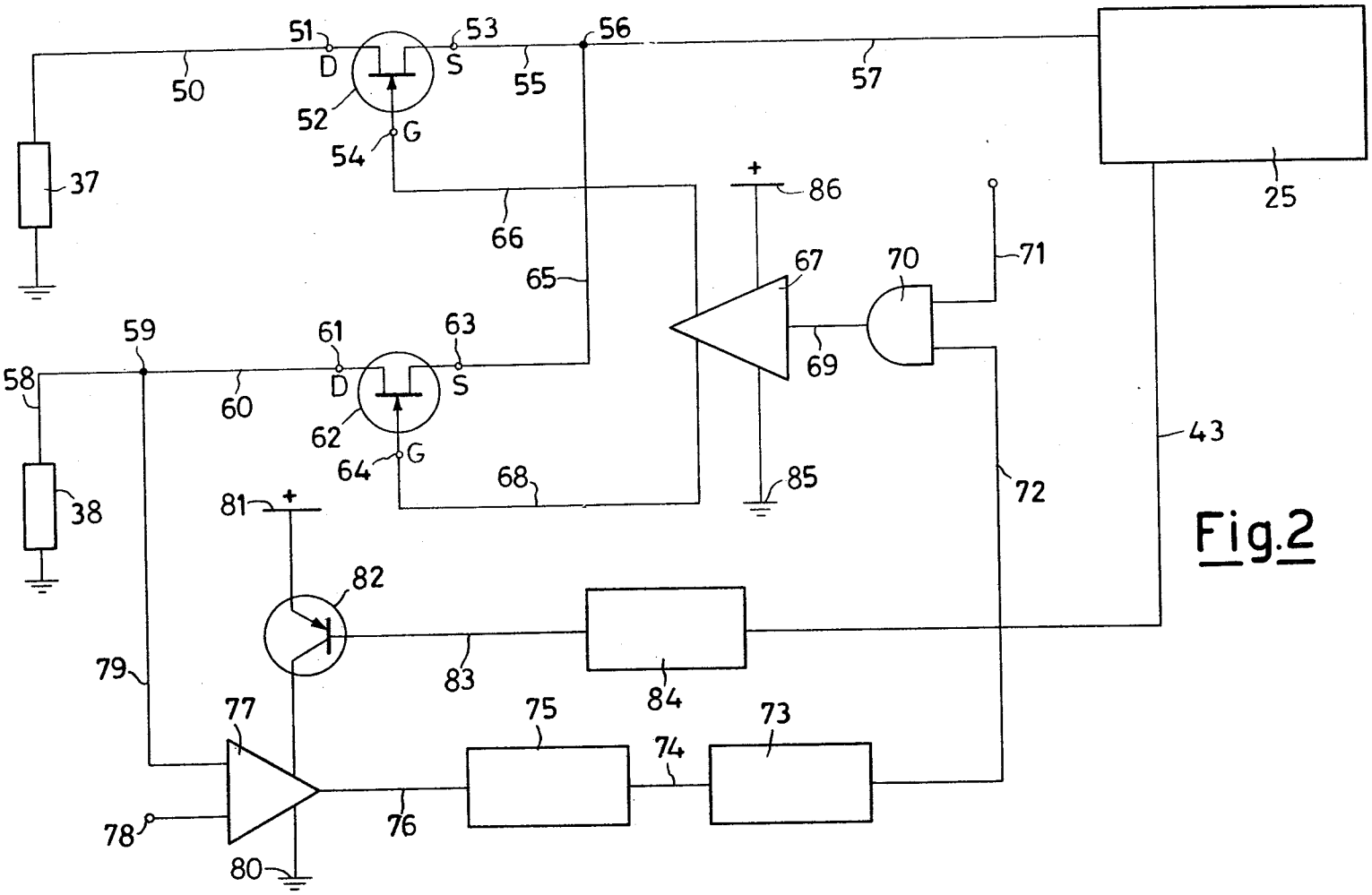
FIG. 2 is a diagrammatic illustration of one possible embodiment of the circuit connected between the two probes and the injection control device.

The probes 37 and 38 are connected via respective conductors 39 and 40 to a circuit illustrated diagrammatically by the block 41 and shown in greater detail in FIG. 2, comprising means sensitive to a parameter indicative of the conditions of operation of the probe 38, and change-over switching means actuated by said sensitive means, which connect the output 42 of the circuit 41 either to the conductor 39 or to the conductor 40.

The signal provided by the circuit 41 reaches the injection control device, and the said device 25 provides a signal 43 for controlling the circuit 41. The probe 37 is activated as soon as the engine begins to operate because it is very close to the engine head and the gas contacting it is sufficiently hot even under this condition of engine operation. The output signal 42 from the circuit 41 is also derived from the probe 37, as the switching means of said circuit are controlled in such a manner as to connect the output 42 to the conductor 39 by the means sensitive to a parameter indicative of the conditions of operation of the probe 38.

With the subsequent heating of the engine, the exhaust gas arrives in the confluence region sufficiently hot to activate the probe 38. When the probe 38 is up to running temperature, said switching means are controlled by the said sensitive means so that they connect the output 42 of the circuit 41 to the conductor 40, so that the signal emitted by the probe 38 reaches the output of said circuit, whereas that supplied by the probe 37 does not.

Through the circuit 41, each of the two probes supplies the device 25 with a signal constituted by one of two voltage levels indicating the quantity of oxygen in the exhaust gas, and therefore the strength of the engine feed mixture.

This signal is used by the device 25 together with the other signals 26 and 27 which are functions of the engine operation parameters, to generate signals fed to the electro-injectors 17, 18, 19 and 20, and which represent the quantities of petrol to be injected into the engine under the different operating conditions. The signal supplied by one of the two probes indicates whether there is a deficiency or an excess of oxygen in the engine exhaust gas relative to the composition corresponding to a feed mixture with a stoichiometric air-petrol ratio, and constitutes a parameter for establishing whether the engine needs a smaller or greater petrol quantity, and allowing the signal generated by the device 25 to be corrected according to the true engine operating parameters.

The probe 37 may also be located in one of the exhaust ducts connected directly to the cylinders and flanged to the head, and the figure shows with a dashed line the probe 37' disposed in the duct 29. In this manner the duct becomes associated with a rather reduced part of the total flow of exhaust gas, but very rapidly reaches the running temperature. The operation of the probe 37' is completely similar to that of the probe 37.

In FIG. 2 the probes 37 and 38 are again illustrated diagrammatically. The probe 37 is connected via the conductor 50 to the drain 51 of the field effect transistor 52. The source 53 of this transistor is connected via the conductor 55 to the node 56, so that both the probes are connected via the respective transistors to the node 56. The gate 54 of the transistor 52 is connected via the conductor 66 to the rocking amplifier 67, and the gate 64 of the transistor 62 is also connected via the conductor 68 to the same amplifier, which is able to switch the transistor 52 to the conducting state while the transistor 62 is locked, and vice versa.

The rocking amplifier 67 is actuated by the logic unit 70 to which it is connected by the conductor 69. The reference numeral 71 indicates a first input to the logic unit 70 which receives a first predetermined (logic) voltage level. A second input to the same logic unit is constituted by the line 72 branching from the unit 73 which forms a second (logic) voltage level reaching the unit 70 through said second input 72.

The unit 73 is connected via the conductor 74 to the unit 75 for adapting the control signal originating from the output 76 of the trip amplifier for exceeding the threshold, indicated by 77.

The reference numeral 78 indicates a first input to the amplifier 77 which receives a predetermined third voltage level (threshold level). A second input to the same amplifier is constituted by the line 79 from the node 59.

The trip amplifier 77 is connected to earth at 80 and to the supply, consisting of the line 81, through the PNP transistor 82, the base of which is connected via the conductor 83 to the control unit 84 which switches the transistor 82 to conducting when it receives a signal from the device 25 through the line 43, for initiating supply to the amplifier 77. This signal is delivered by the device 25 when the probe 37, which operates first, is connected into the circuit of said device 25, the voltage signal supplied by said probe being beyond a predetermined value (and its temperature thus greater than a predetermined value).

The device 25 is provided with elements (not shown) for connecting the probe 37 into the circuit under these conditions, and simultaneously emitting the initiation signal 43 for supply to the amplifier 77, with the transistor 82 entering its state of conduction.

Thus immediately after the internal combustion engine has started, the probe 37 is activated as it is very close to the engine head, and emits a signal constituted by two alternative voltage levels, one corresponding to a weak feed mixture, the other corresponding to a rich mixture, and which tend to a respective asymptotic value corresponding to the running temperature of the probe. The probe 37 is connected via the transistor 52, made to conduct by the rocking amplifier 67, to the device 25 provided with elements which can connect the probe into its circuit as soon as a prechosen one of the said voltage levels reaches a determined value, which is different than the asymptotic value. The signal supplied by the probe 37 is representative of the oxygen concentration in the gas associated with the probe itself, i.e. with reference to FIG. 1, the concentration only in the gas originating from the cylinders connected to the ducts 29 and 32.

This signal may not be completely accurate because it does not refer to the total exhaust gas, but is sufficient for use by the device 25 as a parameter for controlling the petrol injection.

When the signal emitted by the probe 37 is utilised by the device 25, as stated, a signal 43 is emitted which by means of the control unit 84 causes the transistor 82 to conduct, and by which the trip amplifier 37 is supplied by the line 81. The voltage at the terminals of the probe 38 when it becomes activated reaches one input of the amplifier through the line 79. A threshold voltage reaches the other input through the line 78, this voltage assuming a predetermined value which is set when the circuit is set up. Once the amplifier 77 is supplied, it is able to compare the voltage across the probe 38 and the threshold voltage originating from the line 79.

When the probe 38 reaches the thermal activation temperature it is also able to emit two voltage levels, as in the case of the probe 37, one corresponding to a weak engine feed mixture and the other corresponding to a rich mixture.

When the chosen one of these two voltage levels exceeds the threshold voltage at the input 78 on attaining running temperature, the amplifier 77 feeds a signal to the adaptation unit 75 which causes the unit 73 to form a (logic) voltage level. Through the line 72, this voltage level reaches the input of the logic unit 70, which also receives a predetermined reference logic level through the line 71.

If the two signals entering the logic unit form a predetermined combination, the said unit causes the amplifier 67 to rock, and lock the transistor 52 and thus cut out the probe 37, while simultaneously it causes the transistor 62 to conduct, so that the signal emitted by the probe 38 reaches the node 56 and thus the device 25, this signal always being constituted by two voltage levels, one corresponding to a weak feed mixture and the other corresponding to a rich mixture.

From this point onwards the device 25 uses only the signal emitted by the probe 38 as its parameter for controlling petrol injection, this signal being available with a certain lag relative to that emitted by the probe 37, but is derived from the analysis of the entire exhaust gas flow, and is therefore more accurate as an indication of the engine operating conditions than that emitted by the probe 37.

What we claim is:

1. An internal combustion engine comprising devices for controlling the physical quantities relating to the operation of said engine and provided with an exhaust system constituted by an initial plurality of exhaust ducts of a number equal to the number of engine cylinders and flanged to the engine head, said exhaust ducts flowing together at least in pairs into individual ducts which in their turn flow into a single exhaust pipe, comprising at least two probes for analysing the exhaust gas, at least one of which is disposed in one of said ducts upstream of said single exhaust pipe, said probes being connected to said control devices in such a manner that at least one prechosen signal emitted by one of said probes is utilised as the parameter for controlling the physical quantities relating to the engine operation.

2. An internal combustion engine as claimed in claim 1, wherein a first probe is disposed in said single exhaust pipe and at least one second probe is disposed in at least one of the ducts situated upstream of said single exhaust pipe, said probes being operatively connected to the control devices by change-over switching means arranged to exclude said second probe when the first probe is in operation, said change-over switching means being actuated by means sensitive to an electrical parameter indicative of the conditions of operation of said first probe.

3. An internal combustion engine as claimed in claim 2, wherein said probes are connected to a control device by electronic change-over switching means operatively connected to a rocking amplifier actuated by a logic unit which receives a first reference voltage level and a voltage level generated by a level former connected to an adaptation unit operatively connected to a trip amplifier for threshold crossing, said second amplifier receiving a second reference voltage level and a signal which is a function of the operating conditions of the first probe, said second amplifier being connectable to the supply by a transistor actuated by the signal emitted by a control unit connected to the control device, said control unit being made to operate by the control device when said device processes the signal emitted by the second probe.

4. An internal combustion engine as claimed in claim 3, wherein said change-over switching means are constituted by field effect transistors.

5. An internal combustion engine as claimed in claim 2, wherein said second probe is disposed in at least one of said individual exhaust ducts.

6. An internal combustion engine as claimed in claim 2, wherein said second probe is disposed in one of the exhaust ducts flanged to the head of said engine.

7. An internal combustion engine as claimed in claim 1, wherein in at least two of said individual exhaust ducts there is disposed a relative exhaust gas analysis probe arranged to determine the presence of a chosen component in the exhaust gas from the cylinders connected directly to the relative individual exhaust duct, and capable of emitting an electrical signal which is a function of the average concentration of the examined component in said gas, at least one prechosen electrical signal emitted by one of said probes being fed to the control devices for use as the parameter for controlling the physical quantities relating to the engine operation.

* * * * *